US005314329A

United States Patent [19]

Lockwood, Jr.

[11] Patent Number: 5,314,329

[45] Date of Patent: May 24, 1994

[54] PULSE COMBUSTOR IGNITOR SYSTEM

[75] Inventor: Hanford N. Lockwood, Jr., San Mateo, Calif.

[73] Assignee: Bepex Corporation, Minneapolis, Minn.

[21] Appl. No.: 912,147

[22] Filed: Jul. 10, 1992

[51] Int. Cl.[5] ..... F23C 11/00

[52] U.S. Cl. ..... 431/259; 431/263; 431/1; 431/158; 431/208; 431/353

[58] Field of Search ..... 431/263, 1, 208, 240, 431/259, 258, 264, 265, 158, 353, 154; 60/39.826

[56] References Cited

U.S. PATENT DOCUMENTS

| | | | |
|---|---|---|---|
| 3,807,939 | 4/1974 | Carlsson et al. | 431/208 |
| 4,946,384 | 8/1990 | London | 431/264 X |
| 5,044,930 | 9/1991 | Hongo et al. | 431/1 |

FOREIGN PATENT DOCUMENTS

| | | | |
|---|---|---|---|
| 576872 | 1/1959 | Canada | 431/1 |
| 1096684 | 1/1961 | Fed. Rep. of Germany | 60/39.826 |
| 72883 | 4/1960 | France | 60/39.826 |
| 1191687 | 11/1985 | U.S.S.R. | 431/264 |
| 686131 | 1/1953 | United Kingdom | 60/39.826 |

*Primary Examiner*—Carl D. Price
*Attorney, Agent, or Firm*—James P. Ryther

[57] ABSTRACT

A pulse combustor ignitor comprising a small combustion chamber located external to the pulse combustion chamber. A spark ignition source such as a spark plug is associated with the chamber and separate inlets for fuel and air are provided. The fuel/air mixture is ignited by the spark plug and the ignited mixture is directed into the combustion chamber of the pulse combustor until a steady state operation of the pulse combustor is achieved. An air preheater may be used for the air delivered to the ignitor combustion chamber. The flow pattern of the fuel/air mixture and the flame may be controlled by an adjustable passage element located between the respective ignitor and pulse combustor combustion chambers. A flame scanner positioned external to the pulse combustor may be used to sense the entrance of the ignited mixture from the ignitor into the pulse combustor.

8 Claims, 3 Drawing Sheets

PULSE COMBUSTOR IGNITOR SYSTEM

BACKGROUND OF THE INVENTION

Pulse combustor heat sources have been known and available for many years. Such systems operate on an interruptible combustion process that, once started, is self-igniting.

The combustion process of a pulse combustor starts with the mixture of a fuel and air charge in a combustion chamber. An ignition source, such as a spark ignitor, is employed to cause the mixture to burn thereby rapidly increasing the pressure and temperature within the combustion chamber. The increased pressure forces the combustion products to leave the combustion chamber through a tailpipe where they perform the desired work.

The momentum of the gases leaving the combustion chamber lowers the pressure in the combustion chamber to the point where a new charge of combustion air and fuel can be admitted to the combustion chamber. At the same time the reduced combustion chamber pressure causes a small portion of the exhaust gas to return to the combustion chamber where it becomes the ignition source for a subsequent combustion event. A rapid increase in pressure occurs which again forces combustion chamber products to leave the combustion chamber thereby repeating the cycle. The cycle then repeats again and again until the pulse combustor achieves a desired operating temperature level and a steady-state natural operating frequency. As indicated, the process is self-igniting, which eliminates the need for an ignition source for each pulse.

Most pulse combustors are unstable when they are "cold" during the short period necessary for coming up to operating temperature. This is usually caused by a lack of radiation energy from the walls of the combustion chamber, which can contribute to the ignition process, and by variations in the speed of sound due to temperature. This instability is caused by the combustor attempting to operate at several frequencies while it seeks the natural frequency during the initial phase of the combustion process.

Prior art pulse combustors use direct spark ignitors (typically a conventional spark plug), which are located inside the combustion chamber, to initiate the combustion process and sustain it until the operating temperature is achieved or until the process is self-sustaining. Such spark ignitors consist of two electrodes which have a preset distance between them. To initiate ignition, a current is sent to an ignition transformer where the voltage is increased from 110 volts to a range from 3,000 to 10,000 volts. This high voltage causes a spark to develop between the two electrodes in the combustion chamber, which in turn starts the combustion process.

It has been found that the heat from the combustion process, as well as the heat generated by the spark between the two electrodes, will cause an excessive temperature build-up on the electrodes and cause them to melt or oxidize. This shortens their life and results in increased maintenance cost for the pulse combustor system.

SUMMARY OF THE INVENTION

This invention relates to a new type of pulse combustor ignitor which is designed to overcome the deficiencies of the direct spark ignition system. With this arrangement, the electrodes of the spark ignitor are located outside of the primary combustion chamber so that they are protected from the heat of the operating pulse combustor. In particular, the electrodes are mounted in a small chamber where they initiate a fuel rich flame for injection into the pulse combustion chamber to ignite the main flame.

The external ignitor of this invention comprises a compact unit with certain novel design requirements. Specifically, the ignitor consists of a small combustion chamber with a passage that opens into the main pulse combustor, a spark ignition source which can be a spark plug, a gas supply to the ignitor combustion chamber, an ignitor combustion air supply system,, and an electric heat source for the ignitor combustion air. The ignitor is designed to be mounted on the side of the combustion chamber of the pulse combustor. Depending on the size of the pulse combustor, one or more ignitors may be used.

With such a combination of elements, the ignitor of this invention provides an external electric ignition source for a pulse combustor which injects a flame into the combustion chamber to ignite the main flame. The electric ignition means of the ignitor is protected by controlling the environment at the tips of the electrodes thereby increasing their useful life. This is accomplished by using the small ignitor combustion chamber which will reach its operating temperature rapidly, thus reducing the time that the electrodes must be energized.

Another feature of this invention is the provision of a small but high capacity ignitor for a pulse combustor. The combustion chamber of a pulse combustor has a very high heat release rate per unit volume, so the combustion chamber has small physical dimensions relative to its capacity. This limits the room available to mount ignitor systems and requires a very high capacity ignitor for its size. With this invention, a system is included in the pulse combustion ignitor design to preheat the ignitor combustion air which in turn extends the limits of flammability and allows a smaller physical unit.

A still further feature of the invention is the provision for an optional design of the passage between the ignitor combustion chamber and the combustion chamber of the pulse combustor which allows this passage to point the ignitor flame at the optimum location in the combustion chamber to achieve the most effective pulse combustor ignition.

An additional feature of the invention is to provide an ignitor flame of sufficient intensity so that it can be detected by a flame scanner which monitors the flame inside the combustion chamber of the pulse combustor. This provides a safety feature for the ignitor because it allows the system to verify that stable combustion exists within the combustion chamber of the pulse combustor prior to allowing the main gas supply safety valve to open. In prior designs with internal electrodes, the flame safety system could not prove ignition in the combustion chamber without opening the main gas valve and establishing that main gas ignition had occurred. In such a prior art system, failure to achieve main flame ignition would create a dangerous situation, that is, the main safety valve, which is opened during the trial for ignition, would allow the injection of large quantities of gas into the combustion chamber increasing the chance of uncontrolled spontaneous combustion.

DESCRIPTION OF THE PREFERRED EMBODIMENT

Figure 1:
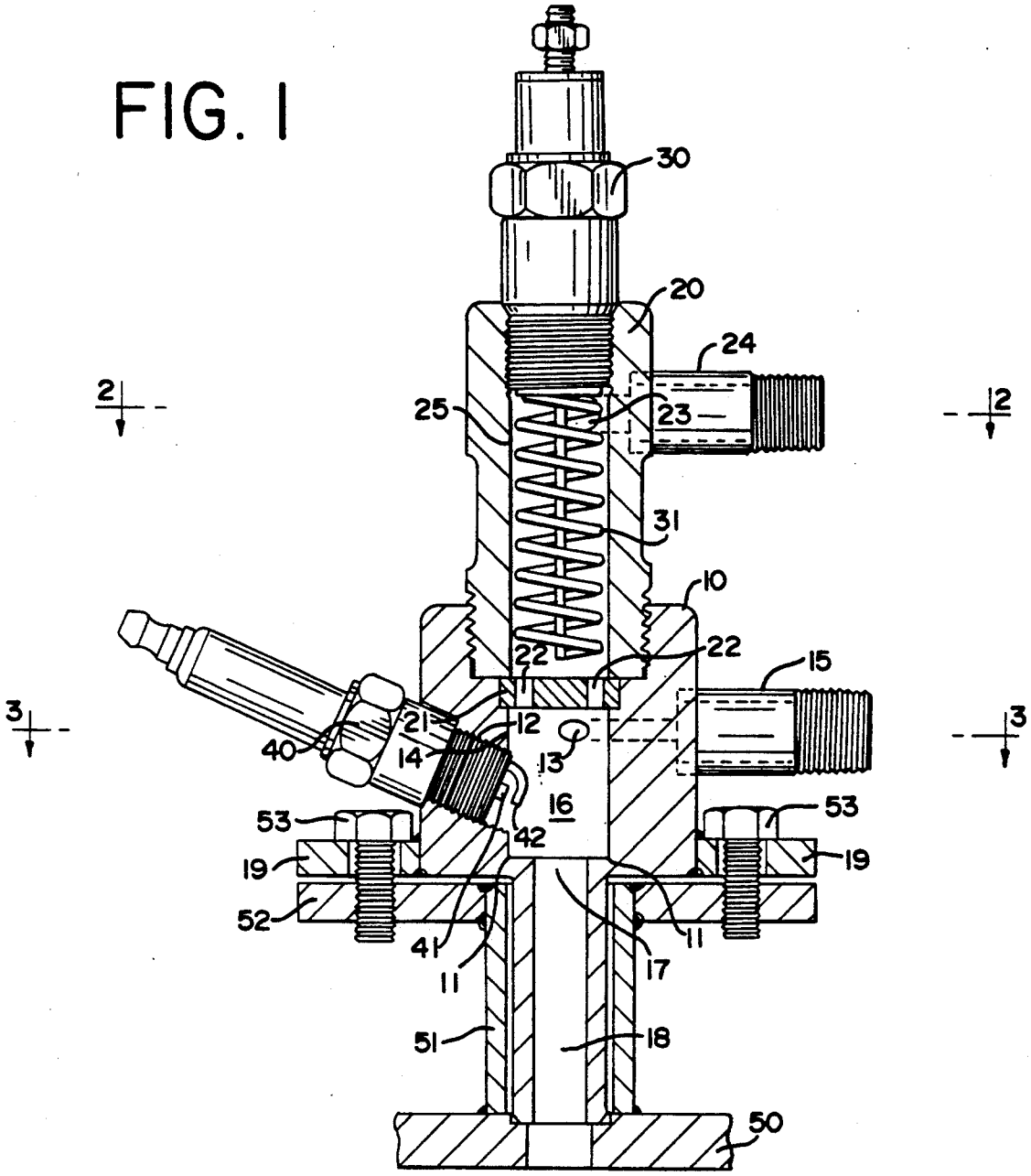
FIG. 1 is a vertical section of the pulse combustor ignitor system of this invention showing the arrangement of internal components.
Figure 2:
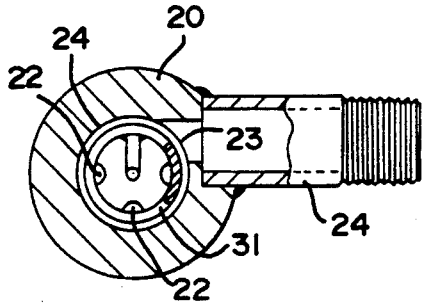
FIG. 2 is a horizontal section of FIG. 1 taken at the centerline of the combustion air inlet and along the line 2—2 of FIG. 1.
Figure 3:
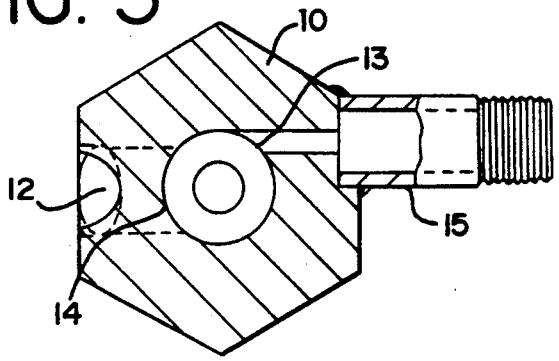
FIG. 3 is a horizontal section of FIG. 1 taken at the centerline of the natural gas inlet with the spark plug removed and along the line 3—3 of FIG. 1.

FIGS. 1, 2 and 3 illustrate the pulse combustor ignitor of the invention which consists of a combustion chamber assembly 10 with a spark plug 40 threaded into a port 12 in the side of the assembly 10. The spark plug is preferably positioned at an angle which may vary between 20 to 80 degrees from the vertical centerline.

Figure 5:
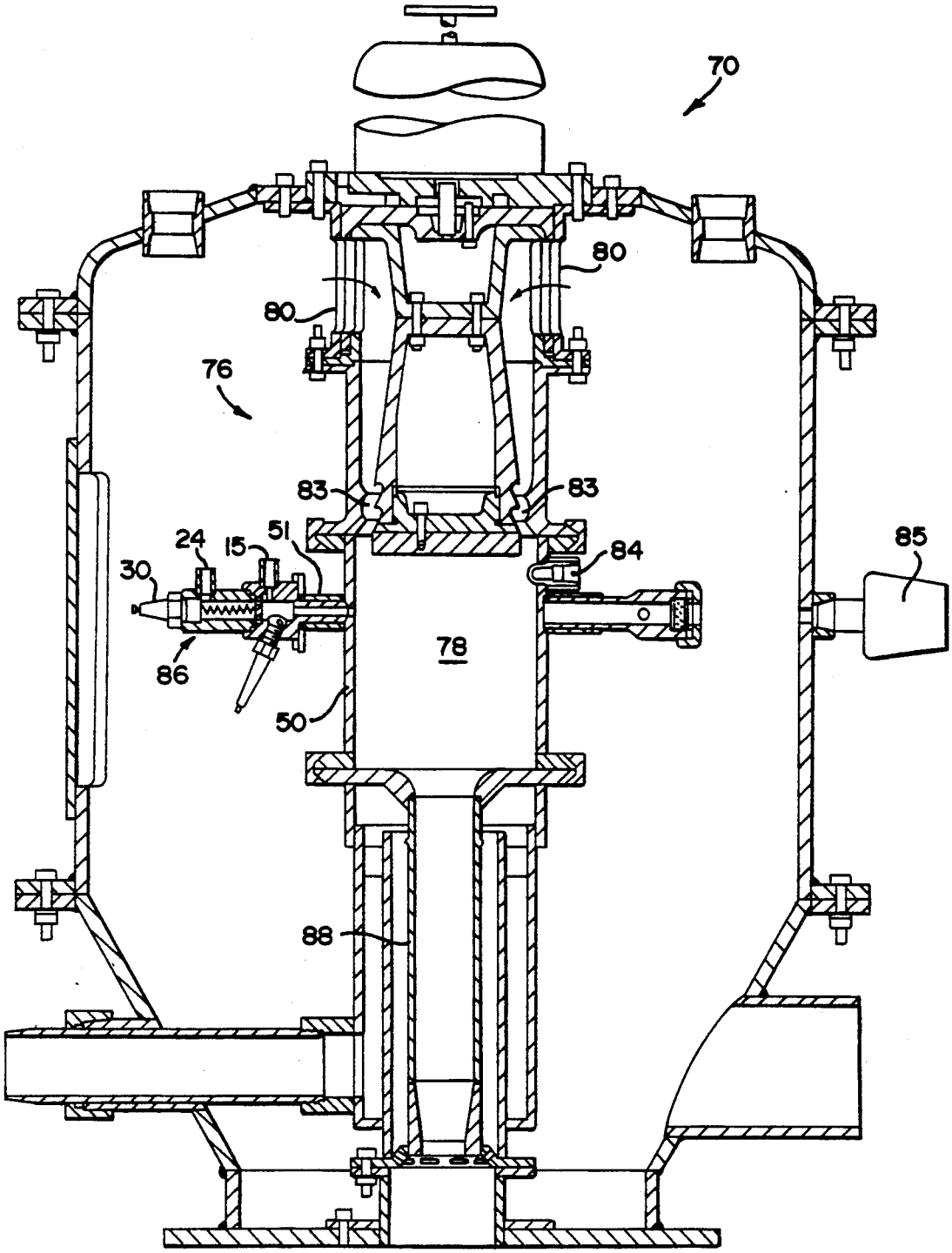

Natural gas enters the combustion chamber 16 of the assembly 10 through opening 13 which is connected to a natural gas supply through gas supply pipe 15 mounted on the outside of the combustion chamber assembly 10 tangent to the circular combustion chamber wall 14. At the bottom of the combustion chamber 16, there is a discharge port 17 connected to a passage 18 which allows the combustion products to exit from the ignitor into the combustion chamber of a pulse combustor such as shown in FIG. 5.

Threaded into the top of the combustion chamber assembly 10 is an air heater assembly 20 which holds an air mixture plate 21 in position at the top of the combustion chamber assembly 10. The air mixer plate has four holes 22 which admit the preheated air from the air heater assembly 20 into the combustion chamber assembly 10.

The air heater assembly 20 includes a glow plug 30 with a coil type electric element 31 designed to transfer heat to the combustion air flowing over the surface of the electric element. Cold combustion air enters the air heater assembly 20 through opening 23 which is tangent to the circular wall 25 on the air heater assembly 20. The opening 23 is connected to the air supply through the air supply pipe 24 mounted on the outside of the air heater assembly 20.

As will be explained in greater detail, the pulse combustion ignitor system is adapted to be mounted on the wall 50 of a pulse combustor 76 (FIG. 5}whereby the ignitor flame issuing from passage 18 can come into contact with the fuel and air mixture that must be ignited to start the main burner. To achieve this, a short tube 51 is mounted on the main burner wall 50. This tube has a flange 52 designed to match the tabs 19 mounted on the outside of the combustion chamber assembly 10. Two bolts 53 then serve to hold the pulse combustor ignitor on the wall 50 of the main pulse combustion burner.

The pulse combustion ignitor is placed in operation by first energizing the glow plug 30 by applying from 12 to 24 volts of direct current from 300 to 400 watts of power to the electric element 31. After 10 to 20 seconds the electric element 31 will achieve operating temperature and glow red hot. The glow plug 30 remains energized the whole time the ignitor flame is required. Concurrent with energizing the glow plug 30, combustion air is admitted to the air heater assembly 20 through the air supply pipe 24 and the tangential opening 23. The combustion air flows over the electric element 31 where it gains temperature and at the same time cools the electric element. The preheating of the combustion air is necessary to extend the limits of flammability of the ignitor, which in turn enables the ignitor to operate in an environment where it experiences wide pressure variations at passage 18, the ignitor outlet. The preheated combustion air exits from the air heater assembly 20 through holes 22 in the air mixer plate 21.

The hot combustion air enters the combustion chamber assembly 10 where it mixes with natural gas. The natural gas is admitted through the gas pipe 15 and the tangential opening 13. The tangential opening 13 enhances the mixing between the gas and the combustion air. The ratio of air to fuel may be either fuel rich, fuel lean or stoichiometric depending on the ignitor application. Usually the ignitor operates fuel rich to control the temperature in the combustion chamber assembly 10.

When the gas and air are mixed, an ignition transformer (not shown) provides a 3,000 to 10,000 volt current to the spark plug 40 which causes a spark to jump between the electrode 41 and the ground wire 42. The spark provides the energy to cause ignition of the air fuel mixture. As the combustion process continues, the burning mixture expands to fill the combustion chamber assembly 10 and begins to exit the chamber through the discharge port 17 and passes through passage 18 until it exits the ignitor and completes its burnout using air in the main pulse combustion burner.

When the ignitor flame enters the main pulse combustion burner, it causes the air/fuel mixture to detonate and start the pulse combustor burner. Usually pulse combustion burners cannot maintain stable self-ignition until they warm up to a self-ignition temperature. Nevertheless, the spark plug 40 can be shut down after approximately 10 seconds and the ignitor will continue to maintain an ignition flame to keep the pulse combustor burner ignited until the self-sustaining temperature is achieved.

More specifically, as the pulse combustor burner detonates during each cycle, it develops a pressure pulse which can enter the ignitor combustion chamber assembly 10 through passage 18. Velocities in the passage 18 can exceed the flame propagation velocities and prevent the ignitor flame from proceeding out through the passage 18. In this case, however, the heat radiation from the combustion chamber wall 14 and the residual combustion occurring in pockets 11 within the combustion chamber 16 maintain the ignitor combustion process so that the process continues even after the spark plug 40 is shut down. This makes the ignitor very stable and makes it uniquely suited to the special ignition problems found in pulse combustion burners.

Figure 4:
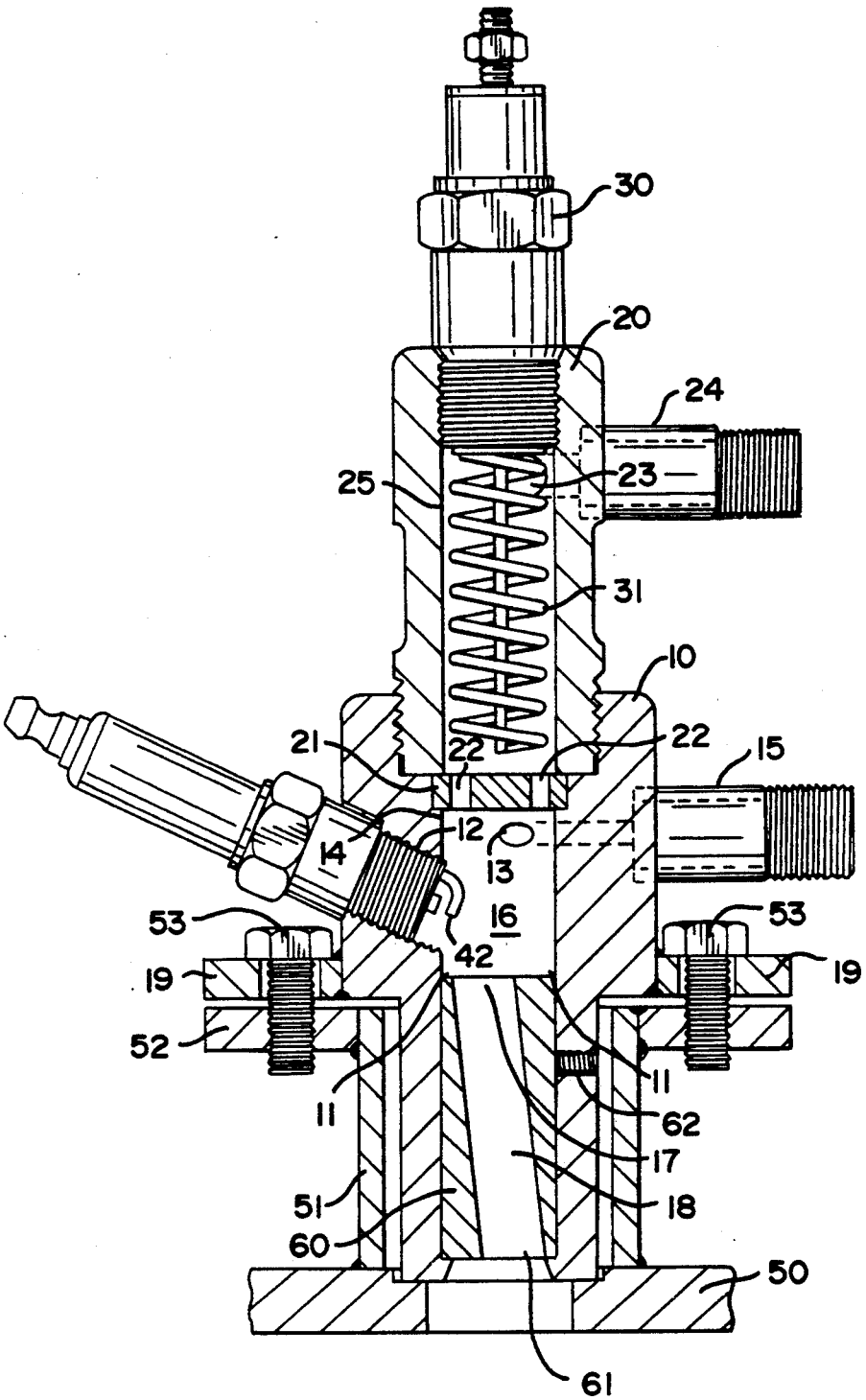
FIG. 4 is a vertical section of an alternate design of the pulse combustor ignitor system with an adjustable outlet nozzle; and, FIG. 5 is a vertical section of a pulse combustor designed for material drying and utilizing a pulse combustor ignitor system of the type contemplated by this invention.

FIG. 4 shows another embodiment of the pulse combustion ignition system. In some applications, the ignitor must be located in a crowded portion of the pulse combustor shell which could prevent placement of the ignitor in the optimum location. This makes it desirable to have some flexibility with respect to the location of the discharge end of the passage 28 for the ignitor. To achieve this, a rotatable exit nozzle 61 is supported adjacent combustion chamber 16. The passage 18 is defined by this nozzle and the passage extends at an angle from one end to the other. By rotating the nozzle, the position of the exit end of the passage can be adjusted, and set screw 62 can then be employed to fix the exit end position. With this arrangement, the angle of entry of the flame into the pulse combustor can be fixed at the most desirable position.

The ignitor system of the invention may be employed in conjunction with a pulse combustor as shown in FIG. 5 and, most particularly, as described in a copending U.S. patent application Ser. No. 07/882,048, filed May 13, 1992, entitled Pulse Combustion Drying System. As shown in that application, such a system may include an upper housing for a pulse combustor unit of the type including a pulse combustor, combustion chamber and tail pipe. An intermediate housing includes a feed introduction chamber and a feed pipe for introduction of solutions or slurries. A lower housing comprises a drying chamber adapted to receive a mixture of material and gases issuing from the feed introduction chamber and, after a predetermined time of residence in the drying chamber, material issuing from the drying chamber may be directed to scrubbers, bag houses, etc., in accordance with conventional practice.

FIG. 5 provides an illustration of a system 70 employing a pulse combustor 76 of the type illustrated in Lockwood U.S. Pat. No. 4,708,159. As described in that patent, a rotary valve system may be employed for periodically feeding the air necessary for supporting combustion in the combustion chamber 78. The air is fed through intake 80, and then through passage 83 communicating with the combustion chamber. The fuel is fed into the combustion chamber through nozzle 84, and an ignitor 86 of the type contemplated by this invention is employed for achieving initial combustion. The ignitor flame can be detected by a flicker type of UV or IR flame scanner 85 which is mounted on the combustion chamber wall directly across from the ignitor 86. As discussed above and in the Lockwood patent, once combustion has started and the operation has reached a steady-state condition using the ignitor of this invention, subsequent ignition can be achieved by back flow of hot gases into the combustion chamber 28 whereby the ignition becomes self-supporting.

A tail pipe 88 communicates with combustion chamber 78 for receiving the pulsating flow of gases. In the system described in the aforementioned application, a material introduction chamber receives this flow of gases and the material to be dried.

It will be understood that various changes may be made in the subject matter described without departing from the spirit of this invention particularly as set forth in the following claims.

I claim:

1. A pulse combustor ignitor for pulse combustor start-up comprising a combustion chamber, a spark ignition source communicating with said chamber, first chamber inlet means and a source of fuel connected to said first inlet means, second chamber inlet means and a source of air connected to said second inlet means, said spark ignition source operating to periodically ignite a mixture of fuel and air entering said combustion chamber, means defining an exit passage communicating with the combustion chamber, and means for connecting the ignitor to a pulse combustor housing whereby the ignited mixture can be directed through said exit passage into the pulse combustor for the short period required for start-up, means for preheating the air delivered to said chamber from said second inlet means, and wherein said exit passage comprises a tubular member defining an inlet end and an outlet end, said tubular member extending between said combustion chamber and said pulse combustor whereby the ignited mixture is directed into said inlet end and then from said outlet end into the pulse combustor, said tubular member extending at an angle relative to the centerline of the combustion chamber, means rotatably mounting said tubular member for thereby adjusting the relative locations of said inlet and outlet ends and to thereby adjust the location of said outlet end relative to the interior of said pulse combustor, and means for securing said tubular member in a fixed position after said adjustment.

2. An ignitor according to claim 1 wherein said chamber includes a fuel/air mixing region, and including an electrical coil interposed between said second inlet means and the mixing region for preheating of the air.

3. An ignitor according to claim 1 wherein the combustion chamber defines pockets offset from the exit passage whereby back pressure pulses from the pulse combustor will not extinguish the ignited mixture in the pockets to thereby maintain the ability of the ignitor to continue to supply an ignited mixture to the pulse combustor.

4. An ignitor according to claim 1 wherein said exit passage has a length substantially greater than its diameter.

5. A pulse combustor ignitor comprising a combustion chamber, a spark ignition source communicating with said chamber, first chamber inlet means and a source of fuel connected to said first inlet means, second chamber inlet means and a source of air connected to said second inlet means, said spark ignition source. operating to periodically ignite a mixture of fuel and air entering said combustion chamber, means defining an exit passage communicating with the combustion chamber, means for connecting the ignitor to a pulse combustor housing whereby the ignited mixture can be directed through said exit passage into the pulse combustor, said exit passage comprising a tubular member defining an inlet end and an outlet end, said tubular member extending between said combustion camber and said pulse combustor whereby the ignited mixture is directed into said inlet end and then from said outlet end into the pulse combustor, the exit passage defined by said tubular member extending at an angle relative to the centerline of the combustion chamber, means rotatably mounting said tubular member for thereby adjusting the relative locations of said inlet and outlet ends and to thereby adjust the location of said outlet end relative to the interior of said pulse combustor, and means for securing said tubular member in a fixed position after said adjustment.

6. An ignitor according to claim 5 wherein said spark ignition source comprises a spark plug.

7. An ignitor according to claim 5 wherein said first inlet means comprises an inlet passage extending tangentially relative to said combustion chamber.

8. An ignitor according to claim 5 wherein said second inlet means comprises an inlet passage extending tangentially relative to said combustion chamber.

* * * * *